US007215313B2

(12) United States Patent
Giraldo et al.

(10) Patent No.: US 7,215,313 B2
(45) Date of Patent: May 8, 2007

(54) TWO SIDED DISPLAY DEVICE

(75) Inventors: Andrea Giraldo, Eindhoven (NL); Mark Thomas Johnson, Eindhoven (NL)

(73) Assignee: Koninklije Philips Electronics N. V., Eindhoven (NL)

( * ) Notice: Subject to any disclaimer, the term of this patent is extended or adjusted under 35 U.S.C. 154(b) by 180 days.

(21) Appl. No.: 10/507,191

(22) PCT Filed: Feb. 12, 2003

(86) PCT No.: PCT/IB03/00580

§ 371 (c)(1),
(2), (4) Date: Sep. 9, 2004

(87) PCT Pub. No.: WO03/077231

PCT Pub. Date: Sep. 18, 2003

(65) Prior Publication Data

US 2005/0104823 A1 May 19, 2005

(30) Foreign Application Priority Data

Mar. 13, 2002 (EP) ..... 2075986

(51) Int. Cl.
*G09G 3/36* (2006.01)

(52) U.S. Cl. ..... 345/98; 345/76

(58) Field of Classification Search ..... 345/55, 345/76, 84–88, 98–100; 349/1, 77, 114
See application file for complete search history.

(56) References Cited

U.S. PATENT DOCUMENTS 5,041,965 A * 8/1991 Chen ..... 345/7
5,115,228 A * 5/1992 Harris et al. ..... 345/5
5,357,355 A * 10/1994 Arai ..... 349/69
5,696,529 A * 12/1997 Evanicky et al. ..... 345/659
5,748,165 A * 5/1998 Kubota et al. ..... 345/96
5,856,819 A * 1/1999 Vossler ..... 345/102
6,104,447 A * 8/2000 Faris ..... 349/5
6,466,292 B1 * 10/2002 Kim ..... 349/143
6,670,943 B1 * 12/2003 Ishii et al. ..... 345/100
6,757,036 B1 * 6/2004 Dolezal et al. ..... 349/113

* cited by examiner

*Primary Examiner*—Amr A. Awad
*Assistant Examiner*—Tom Sheng

(57) ABSTRACT

Driving of a two-sided viewable display (a display that provides information on both sides) is performed by means of mirroring switching circuits Techniques for simultaneous (total or partial) view are also proposed.

18 Claims, 4 Drawing Sheets

TWO SIDED DISPLAY DEVICE

Figure 1:
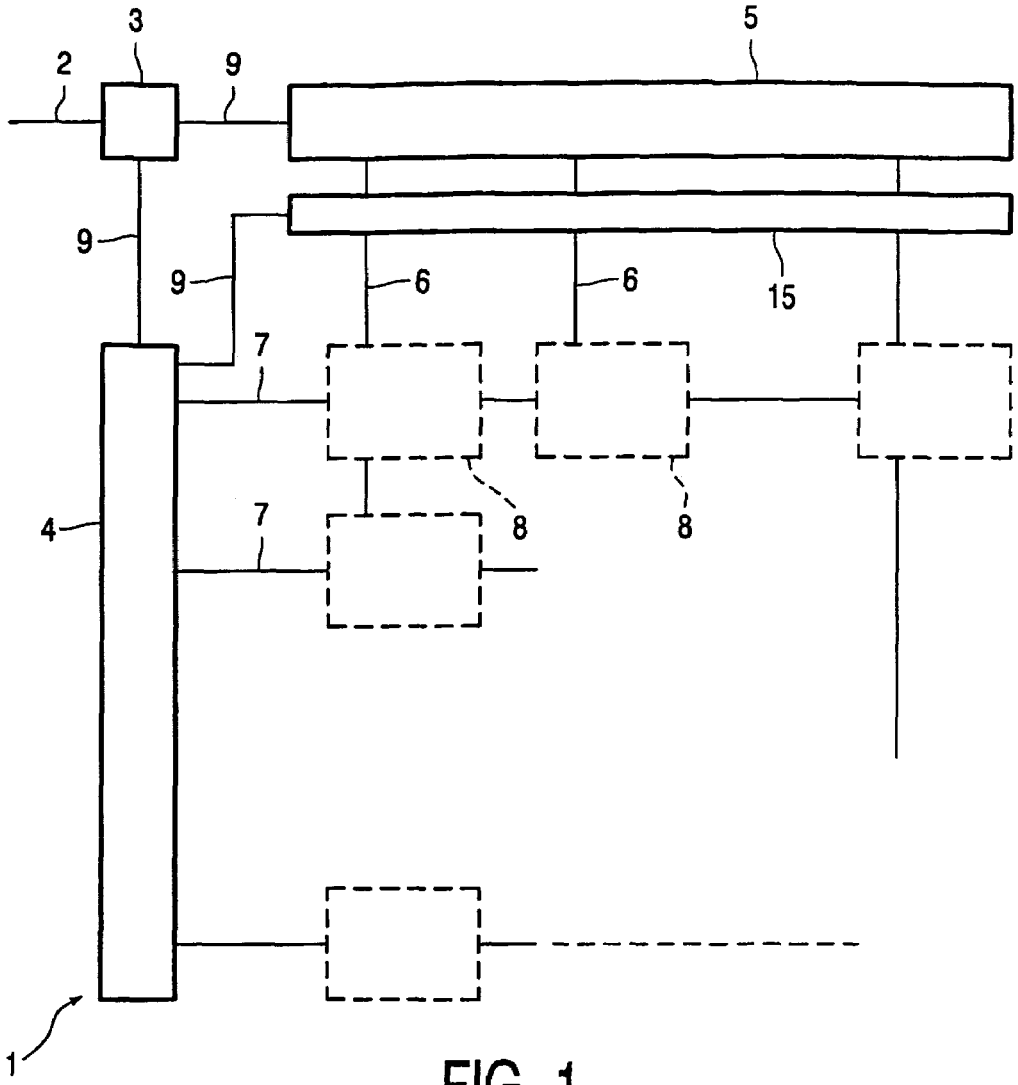

The invention relates to a display device viewable from two opposite sides, the display device comprising at least a first substrate being provided with electrodes for defining picture elements, the device further comprising driving selection means for selecting rows of picture elements in a first mode of driving, the display being viewed from a first direction substantially perpendicular to the substrate said first mode of driving and driving means for selecting rows of picture elements in a second mode of driving the display being viewed from a second direction opposite to said first direction in said second mode of driving.

Examples of such active matrix display devices are TFT-LCDs or AM-LCDs, which are used in laptop computers and in organizers, but also find an increasingly wider application in GSM telephones. Instead of LCDs, for example, (organic). LED display devices may also be used or displays based on other effect such as electrophoresis, mirror displays etc.

Electronic equipment in which data can be made visible from opposite sides finds increasingly growing acceptance in for instance laptop computers and organizers, but also in cash registers.

In the equipment used so far generally two display screens are used, one for each viewing direction, which is rather costly. If a single display layer (electro-optical layer provided with driving electrodes) is realized such a display (a display that shows (video) information on both sides) always requires mirrored data to be readable on one of the sides the so-called mirroring or inversion problem. The inversion function can be implemented in the display controller where data processing replaces pixel data with mirrored (inverted) pixel data. This requires extra electronics (ICs or functional arts of ICs) with this special function and in particular it costs more operations and therefore more power.

It is one of the objectives of the present invention to provide a solution to this problem.

To this end a display device according to the invention device further comprises means for providing data and driving means for mirroring with respect to a mirroring line of a display section the data for the contents of picture elements to be written.

Since the inversion function is now implemented in the display device, no special drivers are needed. The mirroring line may substantially coincide with a column or a line of picture elements or be situated between two columns or two lines of picture elements.

In a preferred embodiment, the driving means for mirroring a display section having columns indexed from 0 to m comprise means for interchanging the contents of picture elements (i, j) and the contents of picture elements (i,m−j), i being a row number of the display driving the display section. This represents mirroring with respect to a column direction. In a similar way mirroring with respect to a row direction is possible.

These and other aspects of the invention will be apparent from and elucidated with reference to the embodiments described hereinafter.

Figure 2:
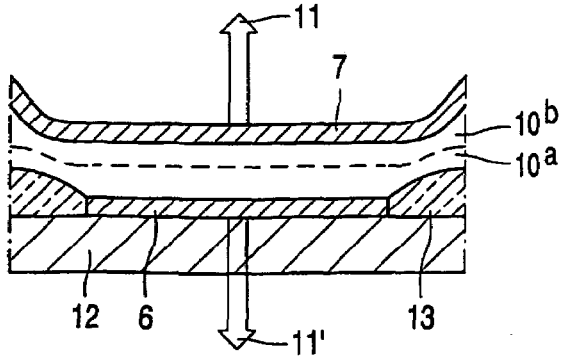
Figure 3:
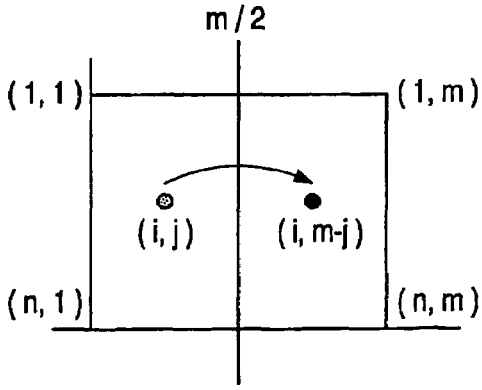
Figure 4:
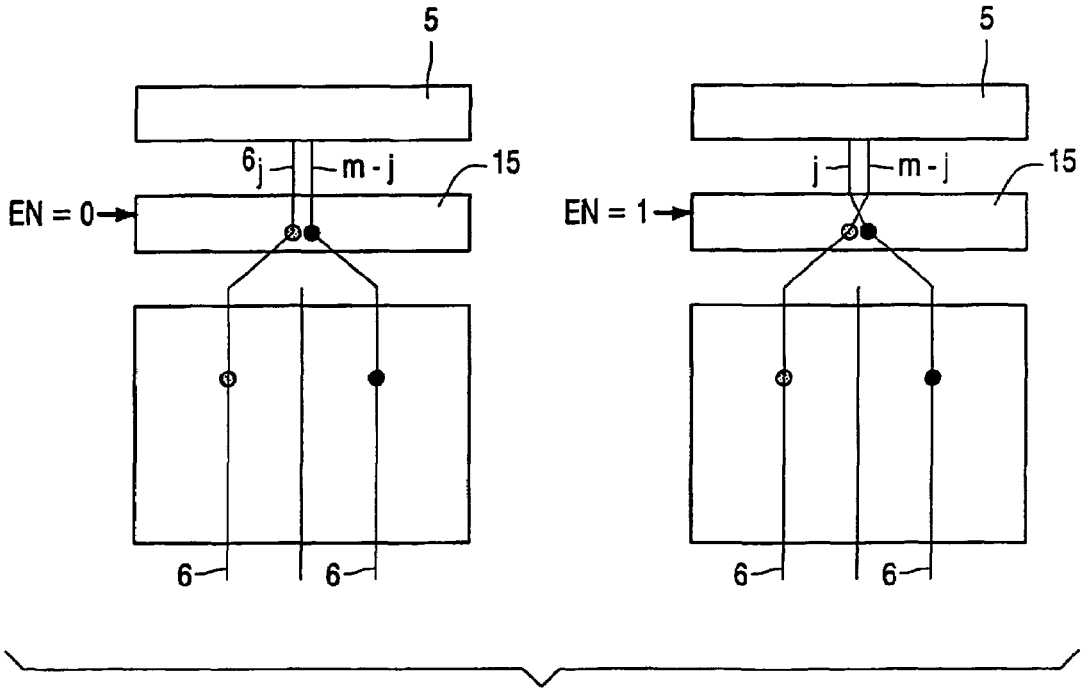
Figure 5:
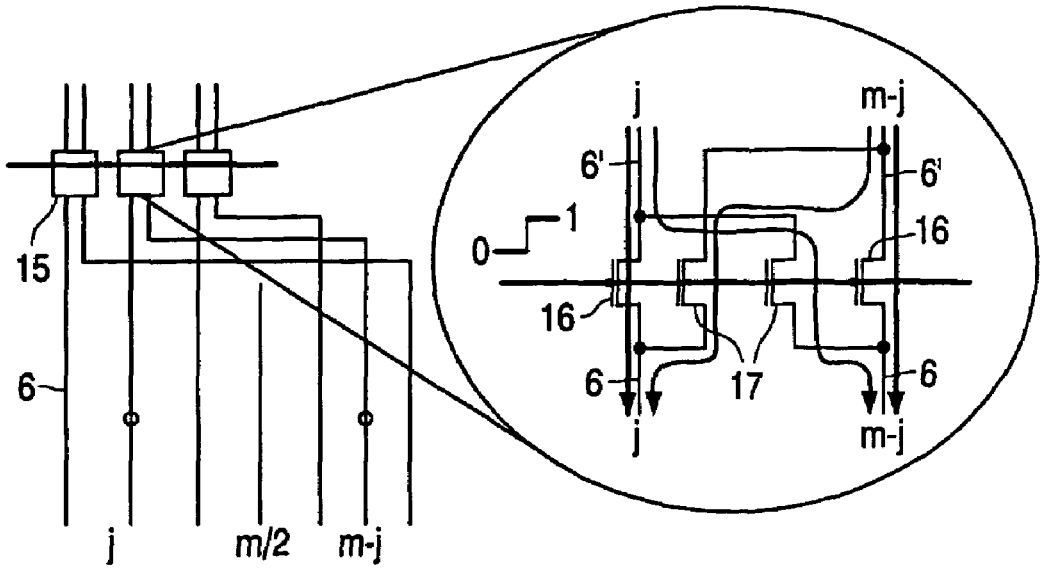
Figure 6:
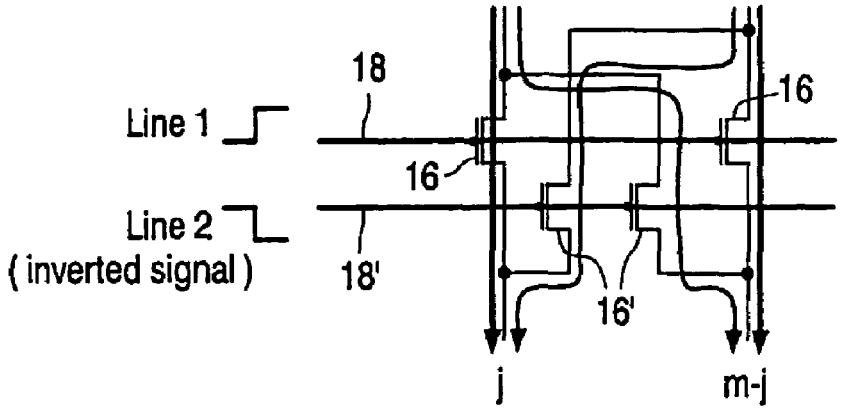
Figure 7:
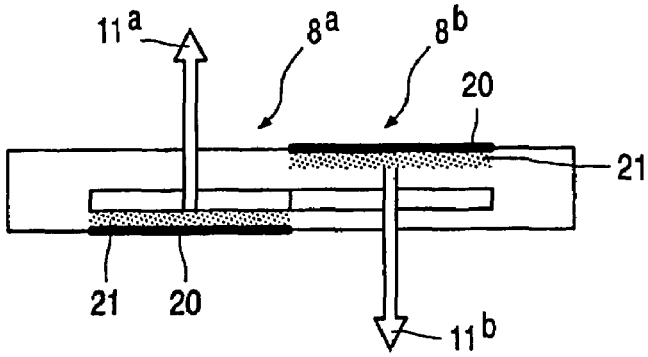
Figure 8:
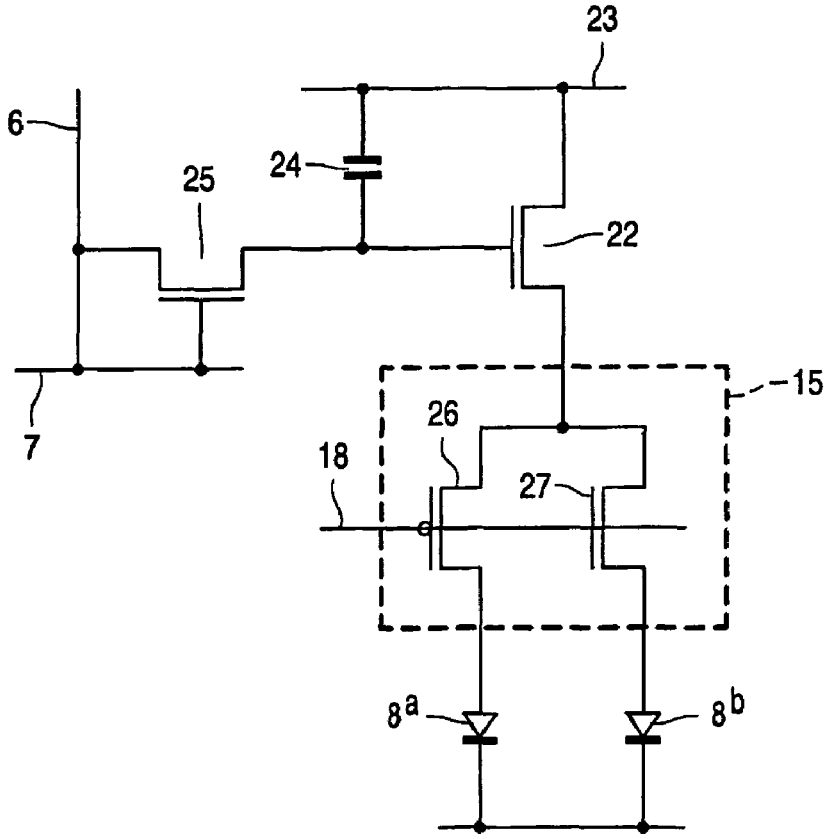

In the drawings:

FIG. 1 is an electric circuit diagram of the display device,

FIG. 2 is a diagrammatic cross-section of a part of a display device to explain the invention, FIGS. 3 and 4 show the mirroring transformation, FIGS. 5 and 6 show embodiments of a part of the device enabling the mirroring transformation while FIG. 7 is a diagrammatic cross-section of a part of a display device to explain the invention and FIG. 8 shows a part of a device enabling the mirroring transformation.

The Figures are diagrammatic and not drawn to scale. Corresponding elements are generally denoted by the same reference numerals.

FIG. 1 is an electric equivalent circuit diagram of a part of a display device 1 to which the invention is applicable. It comprises a matrix of pixels 8 defined by the areas of crossings of row or selection electrodes 7 and column or data electrodes 6. The row electrodes are consecutively selected by means of a row driver 4, while the column electrodes are provided with data via a data register 5. To this end, incoming data 2 are first processed, if necessary, in a processor 3. Mutual synchronization between the row driver 4 and the data register 5 takes place via drive lines 9.

FIG. 2 shows a diagrammatic cross-section of a light emitting pixel 8 on a glass substrate 12. A light emitting layer 10 is provided between transparent row or selection electrodes 7 and transparent column or data electrodes 6. The transparent electrodes in this example are ITO-electrodes. The light-emitting layer 10 in this example comprises sub-layers 10*a*, 10*b* of e.g. poly (p-phenylene vinylene) or PPV and polyethylenedioxythiophene (PEDOT). To prevent inter-pixel leakage the electrodes are mutually separated by insulating layers 13. The use of transparent cathodes and anodes allows emission 111 on one side from the luminescent layer through the transparent cathode 7 and emission 11' on the other side from the luminescent layer through the transparent anode 6 (usually ITO) and the substrate 12 (e.g. glass).

In this example contrast, on both sides will be bad due to the fact that the display itself appears fully or partially transparent. Solutions to this problem are not described in detail here since, as mentioned above, this application mainly deals with a driving problem in the two-sided display, namely that the video information is correct on one side and mirrored in the other.

The image written in the display as perceived by the "back" viewer is different from the one as perceived by the "front" viewer, as a result of the mirroring transformation defined in FIG. 3. Mathematically it is a parity with axis coincident with the vertical middle line. All pixels with column index m/2 are not mirrored while the ones on the left are transformed to the ones on the same row but on the right at equal distance from the middle line and vice versa.

When the inverse of this function is applied to the image in the display the back view is no longer mirrored and therefore it is correct. This function is also called "inversion". The inversion function can be implemented in the display controller where data processing replace pixels (i,j) with pixels (i,m−j). But it requires a chip with this special function and in particular it uses more operations and therefore more power.

According to the invention integration of the inversion function is realized in the display. To this end the display device (the column driver 5) comprises a switch section 15 (FIGS. 1,4) which enables "normal view" (EN=0) and "inverted view" (EN=1). Different ways of realization are possible for the switch. Enabling can also be initiated via connections to sensors that establish which is the preferred view, for example by means of a photodiode or pressure sensor, which determines whether a (mobile phone) display is opened or closed.

Embodiment 1

FIG. 5 shows a first embodiment of the inversion function, which may be integrated in the driving circuit or on the display substrate by means of active matrix technologies (for example polycrystalline silicon technology). The switching units (on one side on top of the columns) comprise four MOS-transistors per pair of columns. PMOS-transistors (switches) 16 interconnect outputs (j) 6' of the column driver 5 to corresponding columns 6 (j). NMOS-transistors (switches) 17 interconnect outputs lines (j) 6' of the column driver 5 to corresponding mirrored column output lines 6 (m−j). With EN=0 the PMOS transistors are open (and the NMOS transistors are closed) and outputs 6',j and 6',m−j respectively, of the column driver 5 correspond to columns 6, j and 6,m−j respectively. With EN=1 the NMOS-transistors (switches) 17 are open (and the PMOS-transistors are closed) and outputs 6',j and 6',m−j correspond to columns 6, m−j and 6,j respectively.

Embodiment 2

FIG. 6 shows a second embodiment of the inversion function, using transistors of the same type. The switching units (on one side on top of the columns) comprise four PMOS-transistors per pair of columns and two enabling lines 18, 18'. With line 18 high (Line1) and line 18' low (Line 2) the PMOS transistors 16 are open (and the PMOS transistors 16' are closed) and outputs 6',j and m−j respectively, of the column driver 5 correspond to columns 6, j and m−j respectively. With line 18' high (Line2) and line 18 low (Line 1) the PMOS-transistors 16' are open (and the PMOS-transistors 16 are closed) and outputs 6',j and m−j correspond to columns 6, m−j and j respectively. An equivalent circuit may be realized with NMOS-transistors, which may be realized in amorphous crystalline silicon technology.

Embodiment 3

In FIG. 7 simultaneous front and back view is realized by making two sub-pixels out of one pixel. One sub-pixel 8*a* emits light 11*a* to the front and the other sub-pixel 8*b* emits light 11*b* to the back. The sub-pixels are operated synchronously with the Enabling Inversion function described above, by means of two additional switches (for example a NMOS transistor 26 and a PMOS transistor 27). Current is provided from a voltage line 23 via transistor 22 which together with a capacitance 24 forms a current source. The current source is enabled by selection of a data voltage from data electrode 6, which is passed to the current source via switch (transistor) 25 by a selection electrode 7, enabling said switch (transistor) 25.

Adding a black matrix 20 and a mirror 21 prevents emission to the wrong side.

The protective scope of the invention is not limited to the embodiments described. Furthermore, although described in the embodiments with respect to LED's the invention is applicable to other display mechanisms like liquid crystal displays, electrochromic displays, electrophoretic displays and other display mechanisms, which allow two-sided viewing (both in passive and active addressing).

As shown in FIGS. 7,8 the two-sided display with inversion switching can also be used for simultaneous front and back view. In another display this is achieved by shutters, for instance by using shutter layers on top of each side, the shutter layers operating synchronously with the mirroring enabling function. Possible shutters could be made with TN-LC (twisted nematic LC), FLC (ferroelectric LC), PDLC (polymer dispersed LC) or a guest/host system with dyes (solution gels).

It is also possible to intentionally invert all or part of the screen (viewing pictures, special effects/split screen). As mentioned above the circuits described may be used also for enabling the mirroring with respect to a row direction.

Also in realizing the mirroring circuits a lot of other possibilities exist, like the use of other techniques, e.g. bipolar transistors.

The invention resides in each and every novel characteristic feature and each and every combination of characteristic features. Reference numerals in the claims do not limit their protective scope. Use of the verb "to comprise" and its conjugations does not exclude the presence of elements other than those stated in the claims. Use of the article "a" or "an" preceding an element does not exclude the presence of a plurality of such elements.

The invention claimed is:

1. A display device comprising:

an array of pixels, a column driver that is configured to drive columns of the array via a plurality of column outputs, and a switch element that is configured to selectively route each column output of the plurality of column outputs to one of two corresponding columns of the array, wherein:

the columns of the array are indexed from 0 to m, the column outputs are indexed from 0 to m, and the switch element is configured to selectively route each (j) column output to one of (j) and (m-j) columns, where j ranges from 0 to m.

2. The display device of claim 1 wherein the array of pixels consists of an odd number of columns, and the column driver provides a center output that bypasses the switch element and is coupled to a center column of the array of pixels.

3. The display device of claim 1, wherein the switch element includes a pair of complementary transistors coupled to each column output, a first transistor of each pair being coupled to a first column of the two corresponding columns of the array, a second transistor of each pair being coupled to a second column of the two corresponding columns of the array, and a common control signal controls each of the first and second transistors of each pair to route each column output to one of the first and second corresponding columns.

4. The display device of claim 3, wherein each pixel includes first and second sub-pixels.

5. The display device of claim 4, wherein the first and second sub-pixels of each pixel include reflecting layers on opposing sides of the pixel.

6. The display device of claim 4, wherein the first and second sub-pixels of each pixel include absorbing layers on opposing sides of the pixel.

7. The display device of claim 4, wherein the first sub-pixels are configured to be viewable from a first direction and the second sub-pixels are configured to be viewable from a second direction that is substantially opposite the first direction.

8. The display device of claim 7, wherein the switch element is configured to selectively route each column output to one of: the first sub-pixel of a first of the two corresponding columns, and the second sub-pixel of a second of the two corresponding columns.

9. The display device of claim 1, wherein the display device is viewable from a first direction and a second direction that is substantially opposite the first direction, and the switch element is configured to be controlled based on whether the display device is being viewed from the first direction or the second direction.

10. The display device of claim 1, wherein the columns of the array of pixels are arranged as horizontal rows of the display device, and rows of the array of pixels are arranged as vertical columns of the display device.

11. A display device comprising:

an array of pixels, each pixel including a first sub-pixel that is configured to be viewable from a first direction and a second sub-pixel that is configured to be viewable from a second direction that is substantially opposite the first direction, a column driver that is configured to drive columns of the array via a plurality of column outputs, wherein each column output is operably coupled to the first sub-pixel of pixels in a first column of the array of pixels and to the second sub-pixel of pixels in a second column of the array of pixels, thereby facilitating viewing of the display device from the first and second directions.

12. The display device of claim 11, wherein the first and second sub-pixels of each pixel include reflecting layers on opposing sides of the pixel.

13. A method of driving a display device, including:

providing a plurality of data signals to a data register having a corresponding plurality of outputs, each output being associated with a pair of columns of the display device, and selectively routing each output to one of the associated pair of columns, wherein:

the columns of the display device are indexed from 0 to m, the outputs are indexed from 0 to m, and each pair of 0) and (m–j) columns are associated with each (j) output, where (j) ranges from 0 to m.

14. The method of claim 13, wherein the display device consists of an odd number of columns, and a center data signal is routed to a center column of the display device.

15. The method of claim 13, including providing a control signal that controls the selective routing of each output, wherein:

the display device is viewable from opposite sides of the display device, and the control signal is provided based on a direction of viewing the display device.

16. The method of claim 13, wherein each column includes first and second sub-pixels of each pixel in the column, and the first sub-pixels are configured to be viewable from a first direction and the second sub-pixels are configured to be viewable from a second direction that is substantially opposite the first direction.

17. The method of claim 16, including determining a direction of viewing, selectively routing the plurality of outputs to the first sub-pixels if the direction of viewing corresponds to the first direction, and selectively routing the plurality of outputs to the first sub-pixels if the direction of viewing corresponds to the second direction.

18. The method of claim 16, including selectively routing the plurality of outputs to both the first and second sub-pixels to facilitate viewing from either the first or second directions.

* * * * *